US010647467B1

(12) United States Patent
Tibbets

(10) Patent No.: US 10,647,467 B1
(45) Date of Patent: May 12, 2020

(54) PAPERBOARD TRAY WITH FOLD-OVER FLANGE

(71) Applicant: Peerless Machine & Tool Corporation, Marion, IN (US)

(72) Inventor: Michael Eugene Tibbets, Converse, IN (US)

(73) Assignee: Peerless Machine & Tool Corporation, Marion, IN (US)

( * ) Notice: Subject to any disclaimer, the term of this patent is extended or adjusted under 35 U.S.C. 154(b) by 0 days.

(21) Appl. No.: 15/713,913

(22) Filed: Sep. 25, 2017

Related U.S. Application Data

(60) Provisional application No. 62/399,647, filed on Sep. 26, 2016.

(51) Int. Cl.

| | |
|---|---|
| ***B65D 21/032*** | (2006.01) |
| ***B65D 21/00*** | (2006.01) |
| ***B65D 1/34*** | (2006.01) |
| ***A47G 19/03*** | (2006.01) |
| *B31B 50/59* | (2017.01) |

(52) U.S. Cl.
CPC ..... *B65D 1/34* (2013.01); *A47G 19/03* (2013.01); *B31B 50/592* (2018.05)

(58) Field of Classification Search
CPC ..... B65D 1/34; B65D 21/0233; B65D 5/56; A47G 19/03; B32B 27/10; B32B 29/00; B32B 2439/00
USPC .... 229/407, 406, 5.84; 220/574, 608, 62.11, 220/645, 657; 206/151, 518; 426/127; 99/DIG. 15
See application file for complete search history.

(56) References Cited

U.S. PATENT DOCUMENTS

| | | | | |
|---|---|---|---|---|
| 257,627 | A | 5/1882 | Van Valkenburg | |
| 1,965,138 | A | 7/1934 | Dunlap | |
| 2,170,040 | A * | 8/1939 | Stuart | A21B 3/13 126/39 M |
| 2,304,278 | A | 12/1942 | Poster | |
| 3,536,248 | A | 10/1970 | Gurlen et al. | |
| 3,834,606 | A * | 9/1974 | Andersson | B65D 1/34 206/204 |
| 4,014,496 | A | 3/1977 | Christensson | |
| 4,114,797 | A | 9/1978 | Manizza | |
| 4,199,097 | A | 4/1980 | Christensson | |
| 4,295,839 | A | 10/1981 | Baker et al. | |
| 4,343,428 | A | 8/1982 | Persson | |

(Continued)

OTHER PUBLICATIONS

Peerless Machine & Tool Corp., 170.0 mm Dia.×13.0 mm Deep Plate for Paperware/Tsurouka; Dated Aug. 18, 2000.

(Continued)

*Primary Examiner* — Christopher R Demeree
(74) *Attorney, Agent, or Firm* — Barnes & Thornburg LLP

(57) ABSTRACT

A paperboard servingware container is provided. This paperboard servingware container may include a bottom panel; a curved transition portion located at the periphery of the bottom of panel. An upwardly extending wall extends from the curved transition portion opposite the bottom panel. An angled peripheral transition located adjacent the upward extending wall opposite the curved transition portion. A ledge portion that extends from the angled peripheral transition opposite the upward extending wall and away from the upward extending wall. A folded over flange portion that is bent downwardly with respect to the ledge portion.

14 Claims, 11 Drawing Sheets

(56) References Cited

U.S. PATENT DOCUMENTS

| | | | | |
|---|---|---|---|---|
| 4,631,046 | A | 12/1986 | Kennedy | |
| 5,323,956 | A | 6/1994 | Marcontell | |
| 5,609,293 | A | 3/1997 | Wu et al. | |
| RE36,158 | E | 3/1999 | Forbes, Jr. | |
| 6,093,460 | A | 7/2000 | Iwaya | |
| 6,500,559 | B2 * | 12/2002 | Hofmeister | B29C 47/0026 383/109 |
| D603,255 | S | 11/2009 | King | |
| 7,862,318 | B2 | 1/2011 | Middleton et al. | |
| 8,011,568 | B2 | 9/2011 | Maeaettae et al. | |
| 8,177,119 | B2 | 5/2012 | Littlejohn | |
| 8,464,871 | B2 | 6/2013 | Wnek | |
| 8,480,551 | B2 | 7/2013 | Wnek | |
| 8,708,148 | B2 | 4/2014 | Wnek et al. | |
| 8,721,321 | B2 | 5/2014 | Middleton et al. | |
| 8,777,010 | B2 | 7/2014 | Wnek | |
| 8,858,858 | B2 | 10/2014 | Middleton et al. | |
| 8,883,237 | B2 * | 11/2014 | Sanders | A47J 37/01 229/406 |
| 9,011,308 | B2 | 4/2015 | Treccani et al. | |
| 9,016,497 | B2 | 4/2015 | Karhu et al. | |
| 9,132,612 | B2 * | 9/2015 | Bohrer | B32B 23/046 |
| 9,187,866 | B2 * | 11/2015 | Sunblad | B65D 1/34 |
| 9,655,461 | B2 * | 5/2017 | Littlejohn | A47G 19/03 |
| 2005/0109653 | A1 * | 5/2005 | Wnek | B65D 1/34 206/515 |
| 2010/0193578 | A1 * | 8/2010 | Sanders | B65D 65/403 229/120 |
| 2012/0118880 | A1 | 5/2012 | Wnek | |
| 2014/0191024 | A1 | 7/2014 | Wnek et al. | |
| 2014/0374472 | A1 | 12/2014 | Treccani et al. | |

OTHER PUBLICATIONS

Peerless Machine & Tool Corp., Bottom Die Cavity Details for Paper ware/Tsurouka; Dated Aug. 24, 2000.
Peerless Machine & Tool Corp., packing slip 49300; Dated Oct. 16, 2000.
Peerless Machine & Tool Corp., 8 21/32"×8 21/32"×¾" DP. Darth Vader plate; Dated Jun. 12, 2006.
Peerless Machine & Tool Corp., a female cavity Hallmark (Darth Vader); Dated Feb. 16, 2006.
Packing slip No. 1107112 Hallmark Cards, Dated Oct. 20, 2006.
Peerless Machine & Tool Corp., 5-13/16" BIK. × 1-1/2" DP. Ultra Style Bowl Fonda Group, Dated Aug. 21, 2009.
Peerless Machine & Tool Corp., Bottom Die Cavity for Fonda Bowl, Dated Feb. 9, 1999.
Packing slip No. 46792, Fonda Group, Inc., Dated Apr. 15, 1999.
Peerless Machine & Tool Corp., 242.45 mm×18.58 mm Deep Three-Compartment Round, Dated Feb. 11, 1994.
Peerless Machine & Tool Corp., Bottom Die Cavity Milling Detail Three-Compartment Round for Tsuruoka, Dated Mar. 10, 1994.
Packing slip to Kanematsu/Tsuruoka, Dated Jun. 1, 1994.
Peerless Machine & Tool Corp. Corn trade—Rev 1 Honeymoon Paper, Dated Apr. 23, 2007.
Peerless Machine & Tool Corp., Female Cavity Honeymoon paper Forming Die, Dated Apr. 19, 2007.
Packing slip No. 1120232 Honeymoon Paper, Dated May 22, 2007.
Statement of Admitted Prior Art, Dated Jan. 24, 2018.

* cited by examiner

PAPERBOARD TRAY WITH FOLD-OVER FLANGE

RELATED APPLICATIONS

The present application relates to and claims priority to U.S. Provisional Patent Application Ser. No. 62/399,647, filed on Sep. 26, 2016. The subject matter disclosed in that provisional application is hereby expressly incorporated into the present application in its entirety.

TECHNICAL FIELD AND SUMMARY

The present disclosure is related to paperboard trays and methods of making same. In particular, this disclosure is directed to a paperboard tray having a folded-over outer flange or rim.

Paperboard plates and trays are very common. They are typically made of a flat paperboard blank and then pressed into a three-dimensional shape such as a plate or tray having a myriad of utilitarian purposes. Paper plates, for example, are often used as disposable dinnerware while paperboard trays may be used to hold or store food such as frozen dinners.

Typically, red and white meat (e.g., beef and poultry) inherently contain a measure of liquid. Such meat are usually packaged in shallow closed-cell polystyrene foam (e.g., Styrofoam) trays and sealed with a clear poly wrapping over top. Neither the Styrofoam nor the poly wrapping absorb the liquid so they make suitable packaging for meat.

A paperboard cup is a common method of holding liquids. Such a cup may be made of coated paperboard, includes a lid, and is handled in such a way as to limit spillage. That said, paperboard cups are not designed to hold liquids for any extended period of time. In the case of soft drinks or coffee, they are made and/or stored in other facilities (i.e., a soda fountain or coffee maker), and only fill a paperboard cup as needed. In addition, the soft drink or coffee is often consumed immediately thereafter.

Packaged meat, on the other hand, is designed to remain stored on a grocery store shelf for several days if not weeks. Current meat packaging (i.e., the Styrofoam tray and plastic wrapping) allow the packaged meat to be tilted during handling with no expectation that liquid from the meat will leak therefrom.

Unlike with Styrofoam, liquid from meat will break down paperboard over time. Even if using a water-resistant polysurface coated paper, any liquids that migrate to the edge of that coated paper will still be able to penetrate into its substrate and ultimately break it down. This is because the coated paper is only coated on the front or on the front and back surfaces. The edges of the paperboard between the front and back surfaces are vulnerable to liquid wicking into its center and breaking it down. For these reasons, a paperboard tray for raw meat has not been a viable substitution for Styrofoam.

An illustrative embodiment of the present disclosure provides a paperboard servingware container. The paperboard servingware container comprises a bottom panel; a curved transition portion located at the periphery of the bottom of panel; an upwardly extending wall that extends from the curved transition portion opposite the bottom panel; an angled or curvedperipheral transition located adjacent the upward extending wall opposite the curved transition portion; a ledge portion that extends from the angled peripheral transition opposite the upward extending wall and away from the upward extending wall; wherein the ledge portion is oriented about parallel to the bottom panel; a folded over flange portion connected adjacent the ledge portion and bent underneath the ledge portion; wherein the bottom panel, the curved transition portion, the upwardly extending wall, the angled peripheral transition, the ledge portion, and the folded over flange portion, are formed of a single continuous paperboard panel having a first surface and a second surface; wherein the first surface of the single continuous paperboard panel is located opposite the second surface of the single continuous paperboard panel; wherein a paper material is located between the first and second surfaces of the single continuous paperboard panel; wherein either or both the first and second surfaces of the single continuous paperboard panel are coated with a water resistant coating; wherein the first surface of the single continuous paperboard panel of the bottom panel, the curved transition portion, and the upwardly extending wall, forms a receptacle sized to carry an item; wherein the second surface of the single continuous paperboard panel of the bottom panel, the curved transition portion, the upwardly extending wall, and the first surface of the folded over flange portion forms an exterior of the paperboard servingware container; wherein the second surface of the folded over flange portion abuts the second surface of the ledge portion; wherein the folded over flange portion includes an end that is exposed toward the second surface of the upwardly extending wall; wherein the paper material extends to the end of the folded over flange portion; an outer transition edge located between the ledge and the folded over flange portion; wherein the outer transition edge serves as an outermost rim edge around the paperboard servingware container; wherein the first surface of the outer transition edge is coated with the water resistant coating; and wherein the outermost rim edge is coated with the water resistant coating.

Another illustrative embodiment of the present disclosure provides paperboard servingware container. This paperboard servingware container comprises: a bottom panel; a curved transition portion located at the periphery of the bottom panel; an upwardly extending wall that extends from the curved transition portion opposite the bottom panel; an angled or curved peripheral transition located adjacent the upward extending wall opposite the curved transition portion; a ledge portion that extends from the angled peripheral transition opposite the upward extending wall and away from the upward extending wall; a folded over flange portion connected adjacent the ledge portion and is bent downwardly with respect to the ledge portion; wherein the bottom panel, the curved transition portion, the upwardly extending wall, the angled peripheral transition, the ledge portion, and the folded over flange portion, are formed of a single continuous paperboard panel having a first surface and a second surface, wherein the first surface of the single continuous paperboard panel is located opposite the second surface; and wherein the first surface of the single continuous paperboard panel of the bottom panel, the curved transition portion, and the upwardly extending wall, forms a receptacle sized to carry an item.

In the above and other illustrative embodiments, the paperboard servingware container may further comprise: the second surface of the single continuous paperboard panel of the bottom panel, the curved transition portion, the upwardly extending wall, and the first surface of the folded over flange portion form an exterior of the paperboard servingware container; the folded over flange portion includes an end that is exposed; the folded over flange portion includes an end that is exposed toward the second surface of the upwardly extending wall; the ledge portion is oriented about parallel to the bottom panel; a paper material is located between the first and second surfaces of the single continuous paperboard panel; either or both the first and second surfaces of the single continuous paperboard panel are coated with a water resistant coating; at least the first surface of the single continuous paperboard panel is coated with a water resistant coating; the second surface of the folded over flange portion abuts the second surface of the ledge portion; the paper material extends to the end of the folded over flange portion; an outer transition edge located between the ledge and the folded over flange portion; the outer transition edge serves as an outermost rim edge around the paperboard servingware container; the first surface of the outer transition edge is coated with a water resistant coating; and the outermost rim edge is coated with the water resistant coating.

Another illustrative embodiment of the present disclosure provides a method of making a paperboard servingware container. The method comprises the steps of: providing a paperboard container press that includes a female press die and a male pressed die, wherein the female press die is seated within a cavity of a female press cavity; wherein the male press die includes a ledge that is configured to act on a ledge portion of a paperboard container; providing the female press die with an edge configured to support the ledge portion of the paperboard container; providing the female press cavity and an angled wall, wherein the angled wall is angled toward the female press die that is fitted into the cavity of the female press cavity, and providing a ledge in the female press cavity that is located adjacent to the angled wall; providing a paperboard container that includes a ledge portion about its outer periphery, and a downward depending flange extending from the ledge portion at the outer periphery; inserting the paperboard container into the paperboard container press, such that the ledge portion of the paperboard container is supported by the edge portion of the female press die; moving the male press die towards the female press die such that the ledge of the male press die engages the ledge of the paperboard container sandwiching the ledge of the paperboard container between the ledge of the male press die and the edge portion of the female press die; moving both the male and female press dies, such that the folded flange of the paperboard container engages the angled wall of the female press cavity, which further folds the folded flange of the paperboard container under the ledge portion of the paperboard container; moving the male and female press dies further, such that the folded flange of the paperboard container engages the ledge of the female press cavity to further fold the folded flange of the paperboard container underneath the ledge portion of the paperboard container, so the folded flange portion becomes located on an underside of the ledge portion of the paperboard container and runs parallel with the ledge portion of the paperboard container; and moving at least a portion of the female press die out from the cavity of the female press cavity to lift the paperboard container from the female press cavity.

In the above and other illustrative embodiments, the method of making a paperboard servingware container may further comprise the steps of: providing at least one spring located between the female press die and the female press cavity; and biasing the female pressed die out from the cavity of the female press cavity from the bias of the at least one spring.

Additional features and advantages of the paperboard tray with the fold-over flange, and method of making same, will become apparent to those skilled in the art upon consideration of the following detailed description of the illustrated embodiments exemplifying best modes of carrying out the paperboard tray with the fold-over flange, and method of making same, as presently perceived.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels may be repeated among the figures to indicate corresponding or analogous elements.

Figure 1:
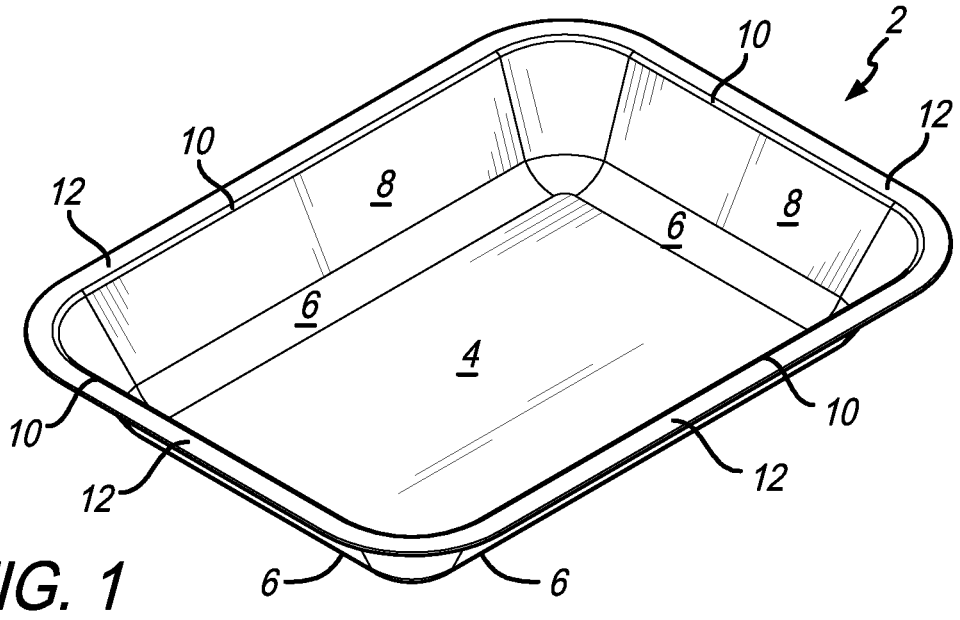
FIG. 1 is a perspective view of paperboard tray according to an illustrative embodiment of the present disclosure.

Corresponding reference characters indicate corresponding parts throughout the several views. The exemplification set out herein, illustrates embodiments of the fold-over flange and method of making same, and such exemplification is not to be construed as limiting the scope of the fold-over flange, and method of making same, in any manner.

DISCLOSURE OF ILLUSTRATIVE EMBODIMENTS

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

An illustrative embodiment of the present disclosure provides a paperboard tray and method of making the same that, in effect, keeps the paperboard edging or ends away from a recessed portion of the tray that holds meat or other moist article. This results in the paperboard tray becoming a viable alternative to Styrofoam. In an embodiment, the paperboard tray may be molded in a shape that is similar to a conventional raw meat tray. In other embodiments, the paperboard may be shaped according to other tray or plate shapes such as square, round, oblong, oval, etc. In these embodiments the periphery of the tray includes a rim flange terminating in a folded-under edge which keeps the same away from the recessed tray portion. In this configuration, with a cover on the tray, liquid stays within the confines of the recessed tray portion and away from the tray's edge.

Another embodiment of the present disclosure includes an illustrative method of making the tray which includes providing a paperboard blank coated with a moisture resistant coating on at least one side. The paperboard blank is pressed into shape using male and female press dies. Illustratively, a second female cavity operates in conjunction with the male and female press dies to assist folding a portion of the flange underneath the rim flange.

Figure 2:
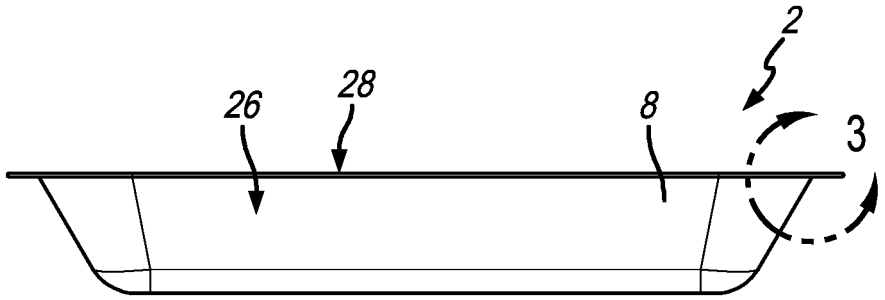
FIG. 2 is a side elevational view of the illustrative paperboard tray of FIG. 1.
Figure 3:
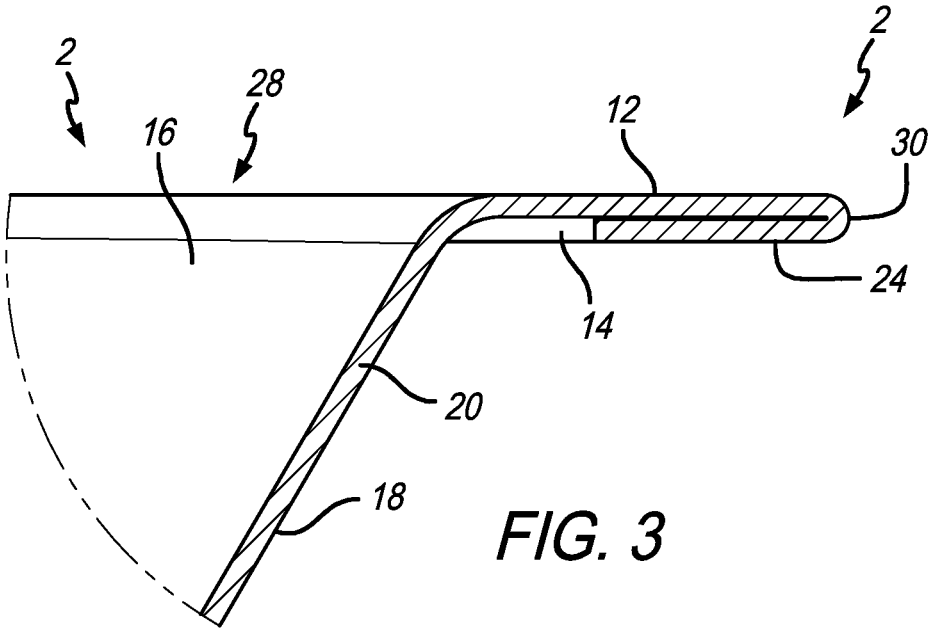
FIG. 3 is a cross-sectional detail view of a portion of the illustrative paperboard tray of FIG. 1 taken as designated by "3" in FIG. 2.

An illustrative embodiment of the present disclosure is shown in the several views of paperboard tray 2 in FIGS. 1 through 3. A perspective view of paperboard tray 2 is shown in FIG. 1. As depicted, paperboard tray 2 includes a bottom panel 4 having curved transition portions 6 located at the periphery thereof, which lead to upward extending walls 8. It is appreciated that curved transition 6 and upward extending walls 8 extend about the periphery of bottom panel 4 to form a container. Adjacent upward extending wall 8 opposite curved transition 6 is an angled or curved peripheral transition 10 of paperboard tray 2. A ledge or edge portion 12 extends from angled peripheral transition 10 opposite upward extending walls 8. Such edge portion 12 provides a rim around paperboard tray 2 as shown. Illustratively, edge portion 12 is oriented generally parallel to bottom panel 4. Coated papers and cardboards are known for resisting moisture. If meat, vegetables, or other moist articles lie on bottom panel 4 of paperboard tray 2, any liquid from those articles will not seep into the paperboard tray 2 because of such barrier coating. This coating may be various press-applied water-based (Aqueous) coating or various poly coatings.

Figure 4:
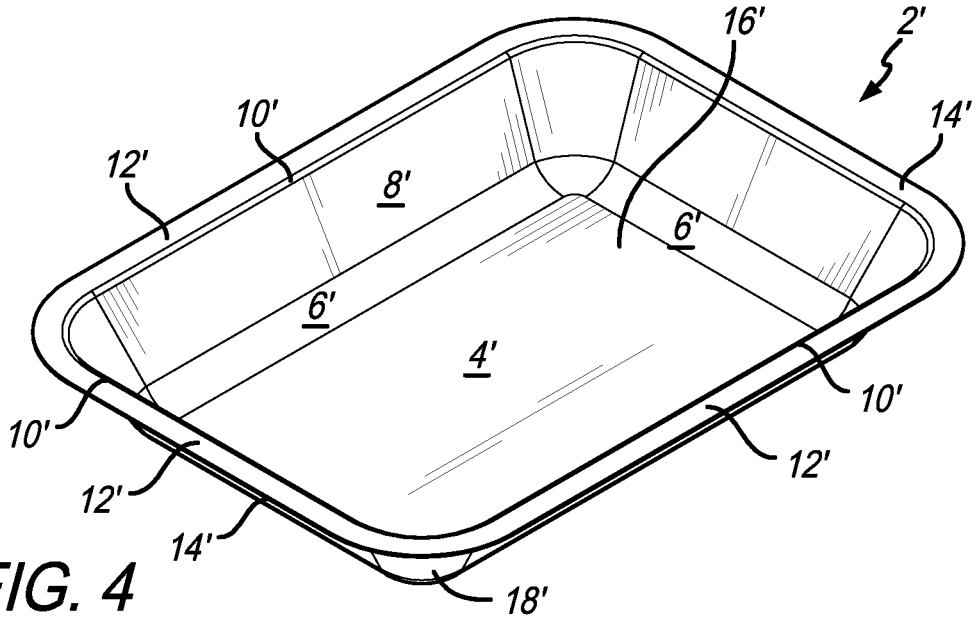
FIG. 4 PRIOR ART
FIG. 4 is a perspective view of a PRIOR ART paperboard tray.
Figure 5:
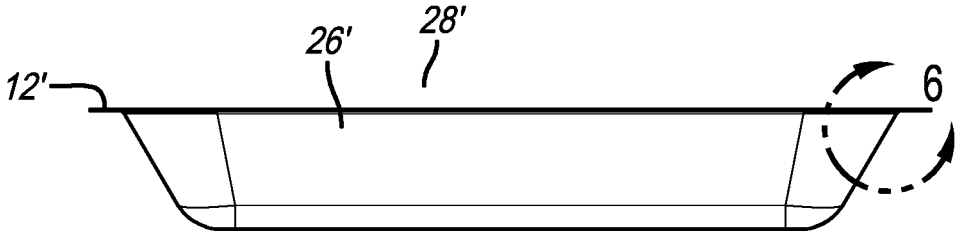
FIG. 5 PRIOR ART
FIG. 5 is a side elevational view of the PRIOR ART paperboard tray of FIG. 4.
Figure 6:
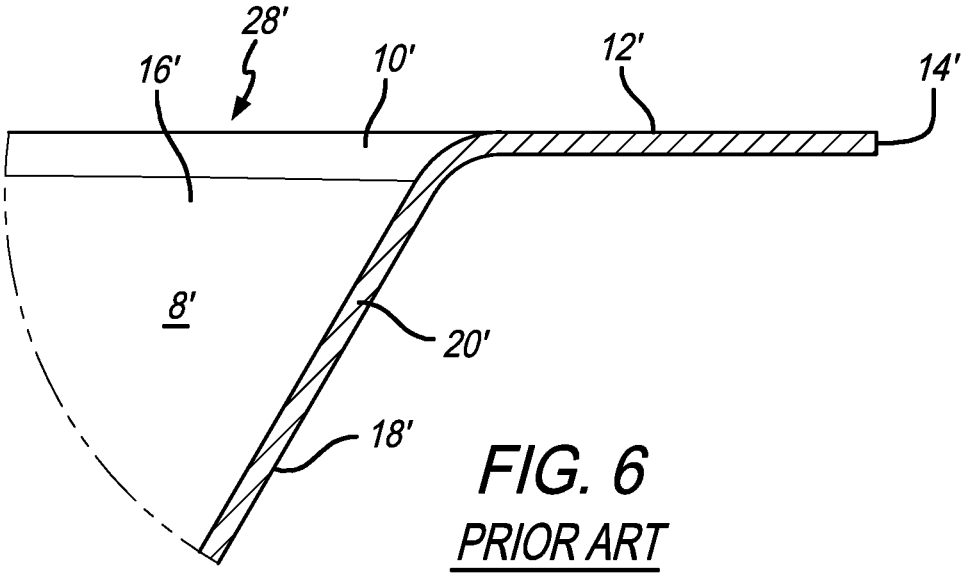
FIG. 6 PRIOR ART
FIG. 6 is a cross-sectional detail view of a portion of the PRIOR ART paperboard tray of FIG. 4 taken as designated by "6" in FIG. 5.
Figure 7:
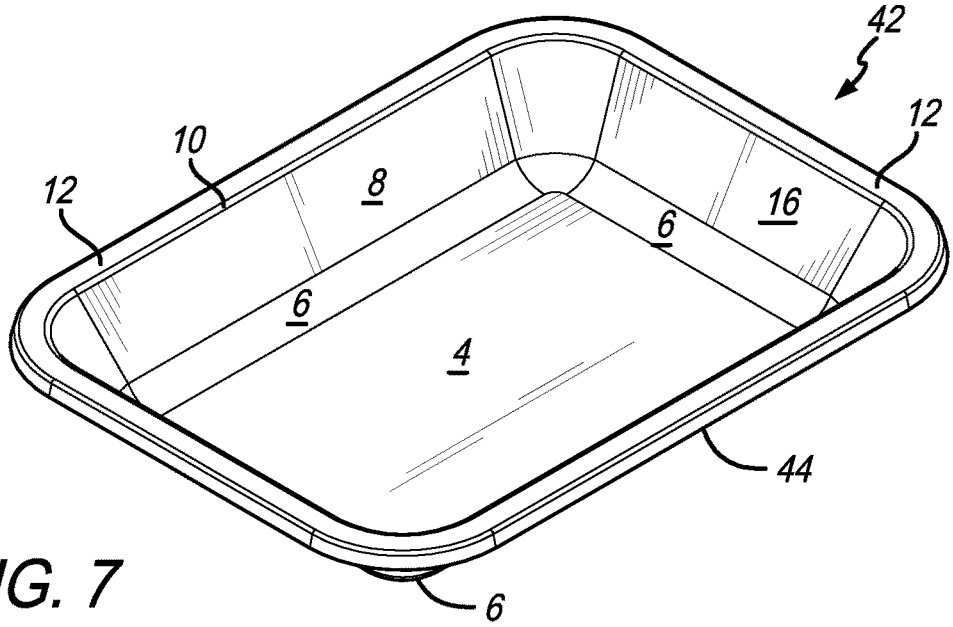
FIG. 7 is a perspective view of paperboard tray according to an illustrative embodiment of the present disclosure.
Figure 8:
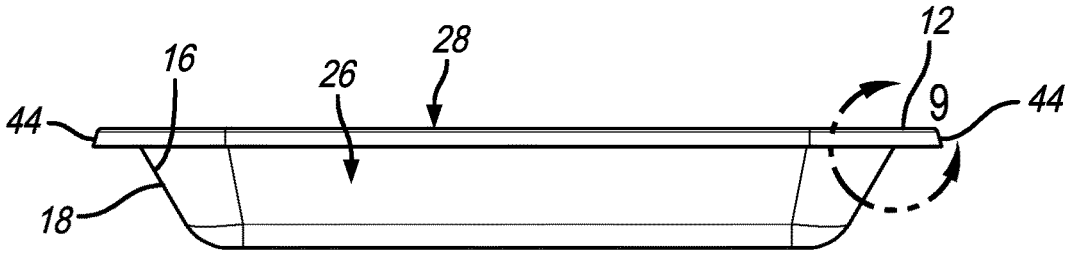
FIG. 8 is a side elevational view of the illustrative paperboard tray of FIG. 7.
Figure 9:
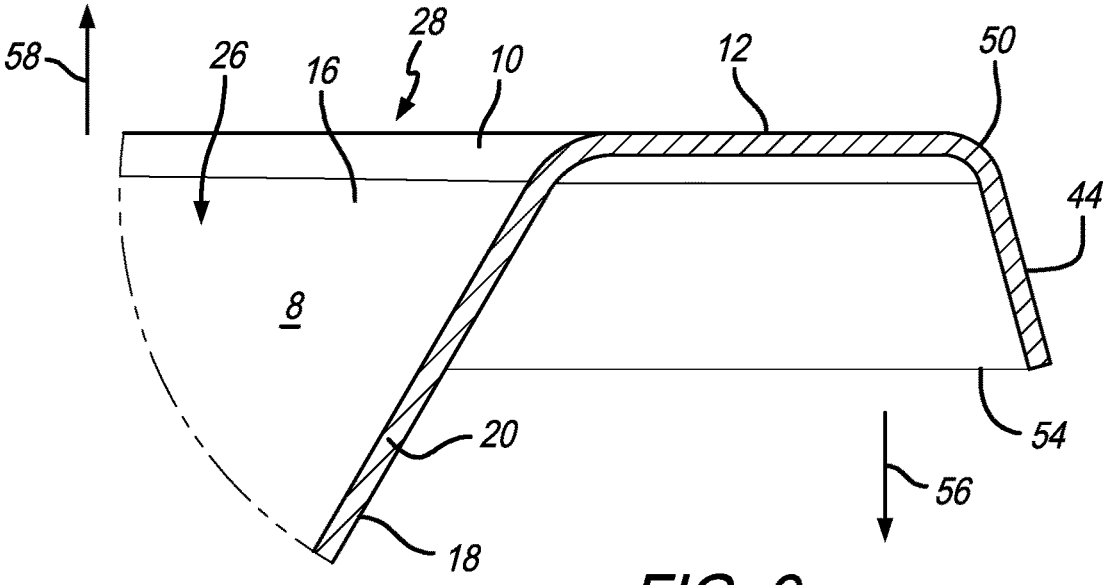
FIG. 9 is a cross-sectional detail view of a portion of the illustrative paperboard tray of FIG. 1 taken as designated by "9" in FIG. 8.

As shown in PRIOR ART FIG. 4, this PRIOR ART tray looks similar to paperboard tray 2 shown in FIG. 1. PRIOR ART tray 2' also includes a bottom panel 4', curved transition 6', upward extending walls 8', angled peripheral transition 10', and edge portion 12'. The problem with such PRIOR ART trays 2' is that at the end of edge portion 12', is the cut end 14' of the paperboard that makes up 2'—as shown in PRIOR ART FIG. 6. The ends of just about all pressed paperboard products, whether they are trays, bowls, plates, or other containers—especially those that hold food—have such cut or trimmed ends. And typically this is not an issue because most pressed paperboard products used in the food industry, such as paper plates and trays, are used for a brief period of time so that any liquid associated with the food remains on the coated surface of the tray, such as surfaces 16' and 18'. If the liquid migrates to the paperboard core 20' located between surfaces 16' and 18', the useful life of the paperboard tray is typically not long enough (i.e., serving or eating meals) to experience significant degradation of the paper material. In certain applications, however, such tray structures are useful but may hold moist food or other articles that contain liquid for longer periods of time. Under those instances, paperboard trays such as tray 2' shown in PRIOR ART FIGS. 4, 5, 6, are not useful because that liquid may migrate into cut end 14'. That liquid will wick into core material 20' and cause structural degradation of PRIOR ART tray 2' over time. As previously discussed, such applications as trays holding meat and vegetables may be used for days if not weeks. That is why conventional Styrofoam or other like moisture-resistant trays are used to hold ground beef and other like articles (such as in a grocery store). The trays are typically wrapped with a plastic wrap and displayed in a meat case for several days. And although paperboard may be a less-costly replacement for Styrofoam, because of cut ends like cut end 14', there is a likelihood that moisture will seep into those ends and wick into core material 20' thereby destroying the structural integrated of paperboard tray 2'.

In an illustrative embodiment of the present disclosure, the risk of fluid migrating into core material 20' is mitigated by a folded over flange 24 of paperboard tray 2 as shown in the detail view of FIG. 3. It is appreciated paperboard tray 2 may include the same coated surfaces 16 and 18 similar to 16' and 18' of PRIOR ART 2'. Paperboard 2 may also have the same paper core material 20 as core material 20'. Paperboard tray 2 may even have the same cut end 14 as 14' of PRIOR ART paperboard tray 2'. The difference is that folded over flange 24 is bent underneath edge portion 12, which protects folded over flange 24 from the contents supported by bottom panel 4, and contained within upward extending walls 8.

As further appreciated by FIG. 2, bottom panel 4 and upward extending walls 8 form a cavity 26 with opening 28 opposite bottom panel 4. Any moisture or liquid-containing articles located within cavity 26, and even possibly covered with a plastic wrap such as when holding ground beef, the exposed end of edge portion 12 is actually peripheral transition edge 30 not end 14 of folded over portion 24. Transition edge 30 is still part of coated surface 16. In other words, the actual edge of paperboard tray, in contrast to end 14' of PRIOR ART paperboard 2', is peripheral transition edge 30 which is part of coated surface 16. This means that even if liquid migrates to peripheral transition edge 30, liquid will not wick into core material 20. The actual exposed end 14 of paperboard tray 2 is tucked underneath edge portion 12 and faces coated surface 18 which is exterior of cavity 26 and protected from opening 28 (see also FIG. 2). By creating a barrier (in this illustrative embodiment— edge portion 12 and exterior of upward extending wall 8), the ability for liquid to reach end 14 is substantially reduced. In contrast with the PRIOR ART, end 14' is essentially located adjacent cavity 26' and opening 28'. Indeed, even if meat is stored in cavity 26' and it, along with paperboard tray 2', are covered with plastic wrap, liquid need only migrate from cavity 26' and between the plastic wrap (not shown) and coated surface 16' at edge portion 12' until it reaches end 14'. At this point, because paper and other cellulosic-type materials commonly used to make pressed paperboard products are hydrophilic, that liquid will draw up into core material 20 and destroy the integrity of paperboard container 2'.

Another illustrative embodiment of the present disclosure provides, as shown in FIGS. 7 through 10, a paperboard tray 42 which illustratively may include a similar bottom panel 4, curved transitions 6, upward extending walls 8, angled or curved peripheral portions 10, and edge portions 12, like the paperboard tray 2 embodiment. The perspective view of such a paperboard tray 42 shown in FIG. 7, for example, may also be made from a pressed paperboard material. Paperboard tray 42 may include a first coated surface 16 lining the interior of paperboard tray 42 and an exterior coated surface 18 lining the exterior of paperboard tray 42 also similar to paperboard tray 2 (see also FIGS. 8 and 9). Core material 20, as particularly shown in the detail view of FIG. 9, may be the same cellulosic paper material as both core material 20 of paperboard trays 2 and 20' of PRIOR ART paperboard tray 2'. A distinction between paperboard tray 2 and paperboard tray 42 is the latter having a folded flange 44 that is directed away from cavity 26 and opening 28 of paperboard tray 42, but not folded completely under edge portion 12 as particularly shown in FIG. 3 of the prior embodiment. Instead, exposed end 54 is exposed in a direction that is opposite of opening 28 of cavity 26. A peripheral transition edge 50 is located spaced apart from angled peripheral transition 10 with edge portion 12 located there between. Peripheral transition edge 50 still has coated surface 16 to protect that edge of paperboard tray 42. Folded flange 44 is angled downward and away from upward extending wall 8 to cause exposed end 54 to be directed downward in a direction 56 that is generally opposed to the direction 58 of opening 28. This embodiment, therefore, provides a flanged lip around an underside outer periphery of paperboard tray 2 while keeping exposed end 54 away from opening 28. Also, rigidity may be improved by creating a box section as compared to a flat flange.

Figure 10:
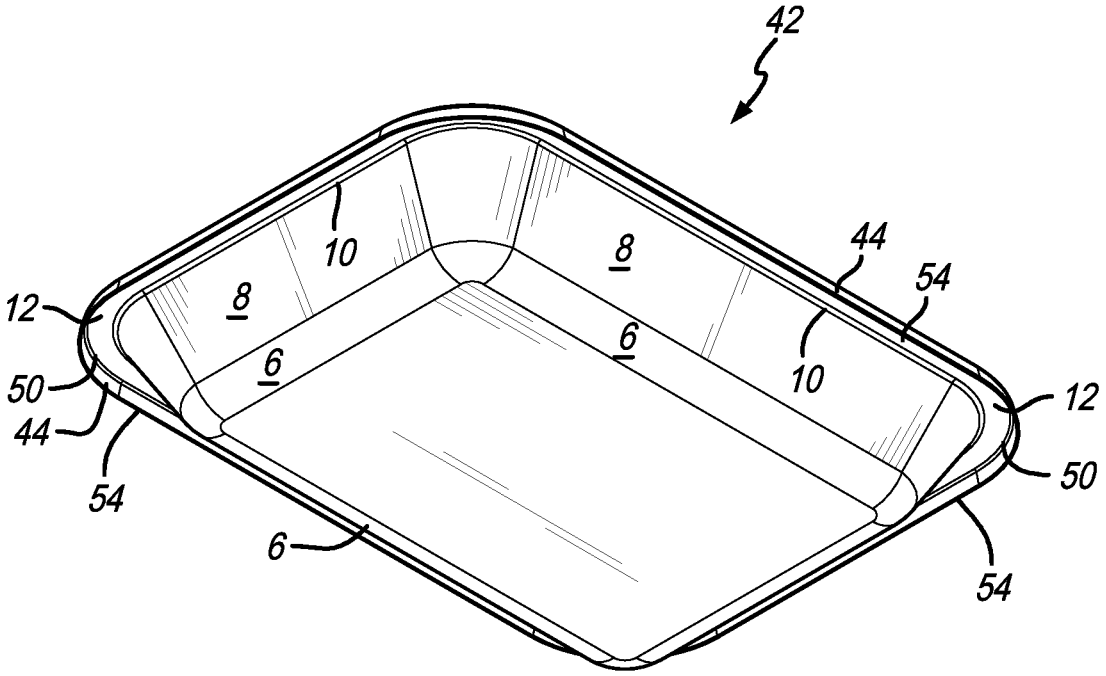
FIG. 10 is an underside perspective view of the illustrative paperboard tray of FIG. 7.

An underside perspective view of the illustrative embodiment of paperboard tray 42 is shown in FIG. 10. This view further extenuates how exposed end 54 is directed away from opening 28 (see also FIGS. 7, 8, 9). In this view, such opening is not visible.

Figure 11:
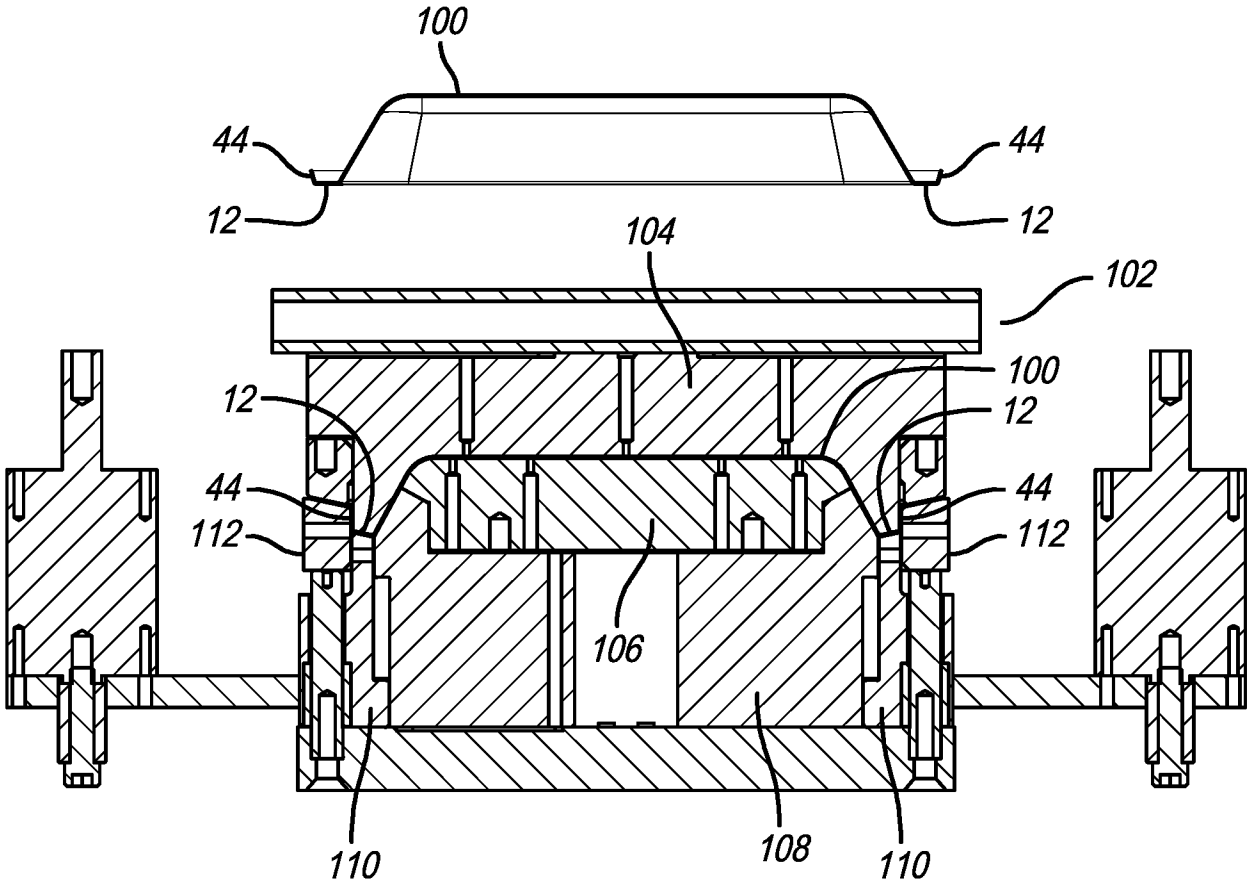
FIG. 11 is a side cross-sectional view of a pressboard press.

An illustrative method of making trays 2 and 42 are shown in the views of FIGS. 11 through 16. A cross-sectional view of pressboard container press 102, along with a formed container 100, is shown in FIG. 11. Pressboard container 100 is similar to pressboard tray 42 shown in FIGS. 7 through 10. Notably, pressboard container 100 includes edge 12 and folded flange 44 similar to the structure shown with respect to paperboard tray 42 in FIGS. 7 through 10. Forming paperboard tray 100 is accomplished using press 102 also shown FIG. 11. Here, a tray 100 is also shown located between female press die 104 and male press die 106. Dies 104 and 106 are depicted in their fully closed position. The contours of such dies 104 and 106 are what form the shape of tray 100. Sidewall die 108 assists in forming the sidewall portion of tray 100. Lower edge die 110, in combination with a portion of female press die 104, as shown also assist forming edge 12 of paperboard container 100. Similarly, a side flange die 112 forms folded flange 44 on tray 100. A skilled artisan, upon reading this disclosure, will understand the further structures herein as part of the press to make the paperboard container.

Figure 12:
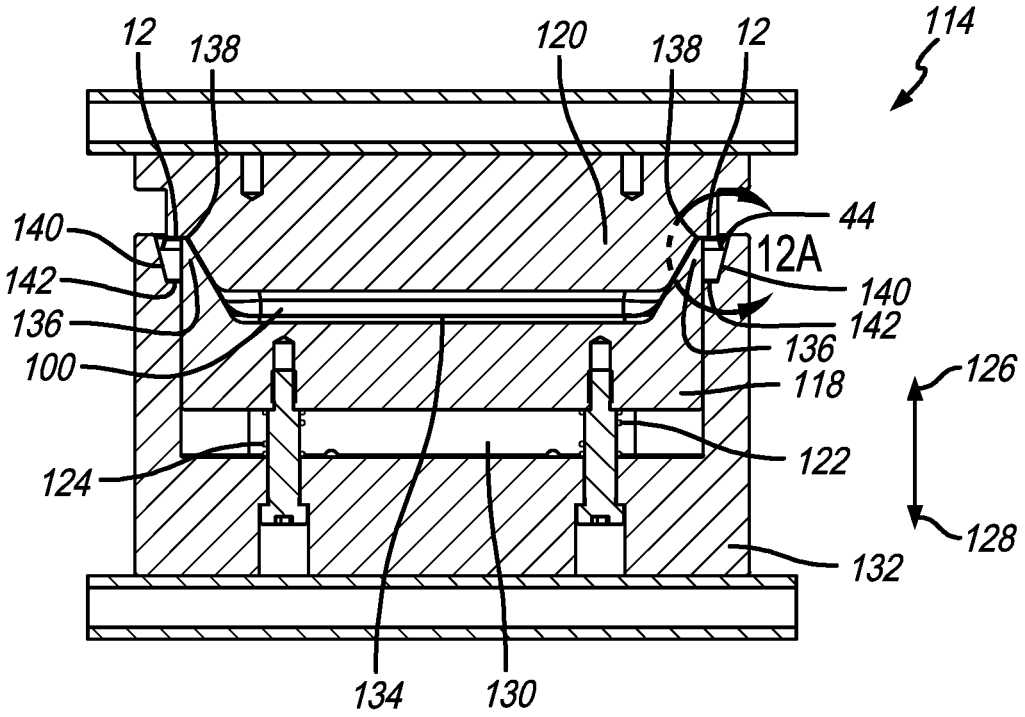
FIG. 12 is a side cross-sectional view of a pressboard press.
Figure 12A:
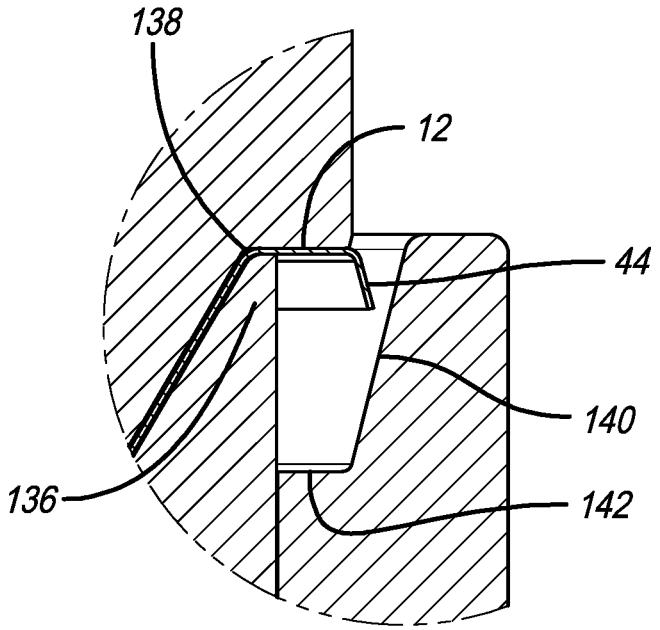
FIG. 12A is a side cross-sectional detail view of the pressboard press of FIG. 12 taken at "12A"

In this illustrative embodiment, once paperboard container 100 is formed, it is transferred to a second press assembly to fold flange 44 into folded over flange 24 as shown in the paperboard tray to embodiment of FIGS. 1 through 3. FIGS. 12, 12A, 13, 13A, 14, 14A, 15, and 15A, depict cross-sectional side views of paperboard container press 114 that includes a female press die 118 and a male press die 120. As shown in FIG. 12, female press die 118 is spring-loaded via springs 122 and 124 to bias female press die 118 in direction 126 opposite direction 128. Female press die 118 is spring-loaded and fitted into cavity 130 of female press cavity 132. This allows female press die 118 to be movable relative to female press cavity 132 in order to assist forming folded over flange 24 as further shown herein. Particularly, at this beginning stage, folded flange 44 of paperboard container 100 is shown fitted into cavity 134 of female press die 118 as shown in FIG. 12A. Edge 12 of pressboard container 100 sits on edge 136 of female press die 118 and is sandwiched between edge 136 of female press die 118 and edge portion 138 of male press die 120 as shown. Female press cavity 132 further includes an angled wall 140, as shown, configured to engage folded flange 44. In this embodiment, angled wall 140 angles inwardly towards cavity 130 of female press cavity 132 in order to direct folded flange 44 inward towards the body of paperboard container 100 and, particularly, the underside of edge 12 of same. Angled wall 140 terminates at a ledge 142 that further engages folded flange 44.

Figure 13:
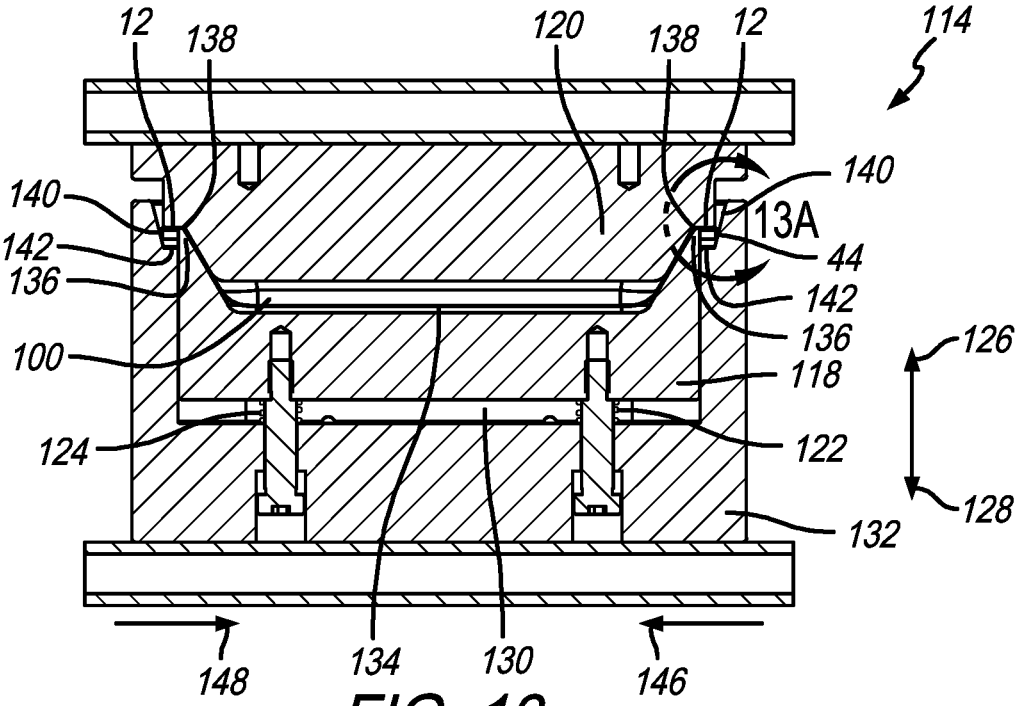
FIG. 13 is another side cross-sectional view of the pressboard press of FIG. 12.
Figure 13A:
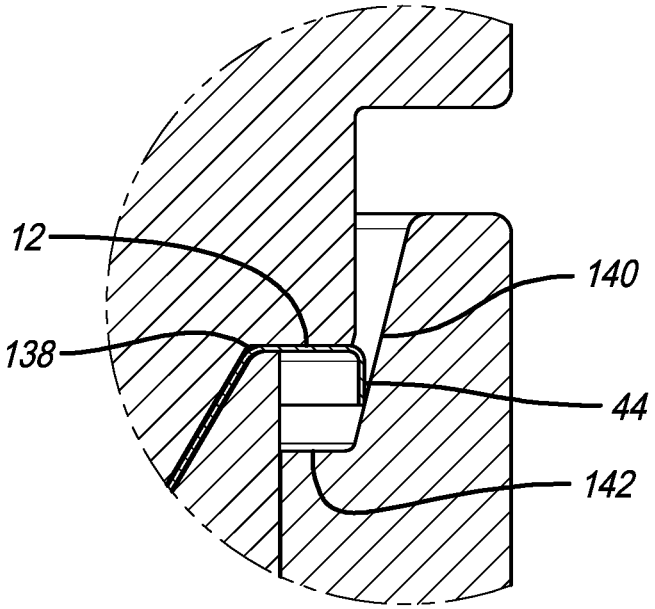
FIG. 13A is a side cross-sectional detail view of the pressboard press of FIG. 13 taken at "13A"

Another cross-sectional elevation view of paperboard container press 114 is shown in FIG. 13. This view further depicts the progression of dies 118 and 120 in female press cavity 132 in order to further form paperboard container 100. In this view, male press die 120 is moved downward in direction 128 further into cavity 134 of female press die 118. As this happens, and as shown in the detail view of FIG. 13A, edge portion 138 of male press die 120 pushes onto edge 12 and folded flange 44 in direction 128 as well. Folded flange 44 moves against angled wall 140 in order to bend folded flange 44 further inward toward inward directions 146 and 148. At this position, however, folded flange 44 may be bent downward to about 90 degrees from edge 12. It is appreciated that the die positions of paperboard container press 114 are intermediate. Because of the movement of male press die 120 in direction 128, it acts on female press die 118 causing it to move and direction 128 into cavity 130 against the bias of springs 122 and 124.

Figure 14:
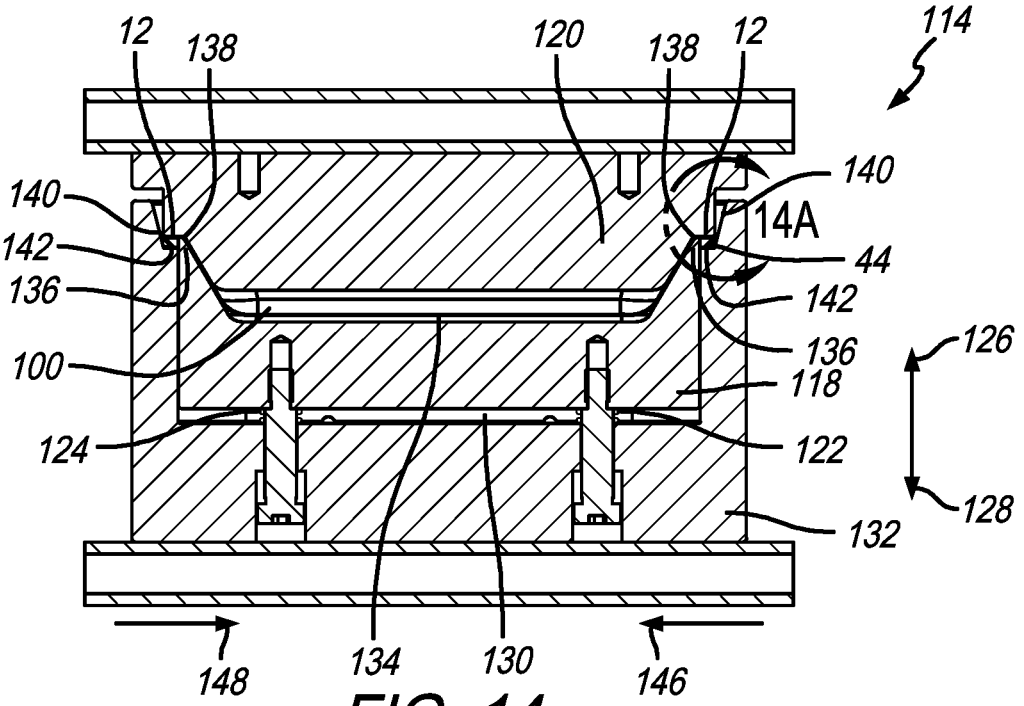
FIG. 14 is another side cross-sectional view of the pressboard press of FIG. 12.
Figure 14A:
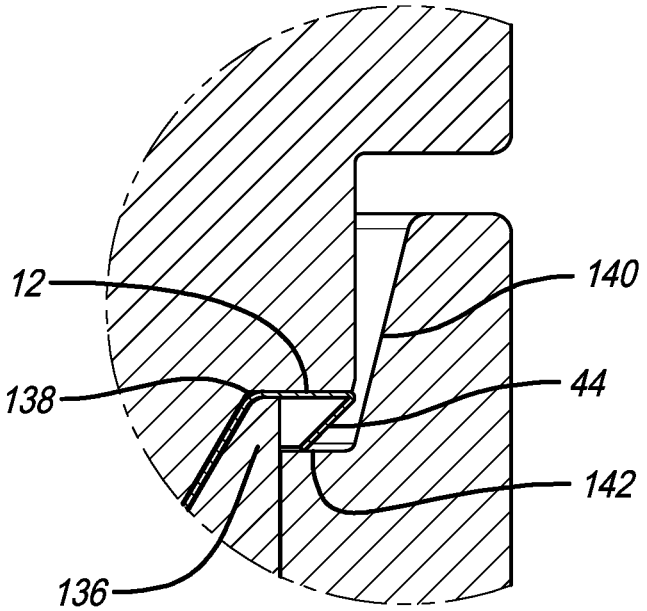
FIG. 14A is a side cross-sectional detail view of the pressboard press of FIG. 14 taken at "14A"

Another side cross-sectional elevation view of paperboard container press 114 is shown in FIG. 14. This view continues the progression started as shown in FIG. 12 to further fold flange 44 underneath edge 12 to form folded over flange 24. As depicted herein, male press die 120 is moved even further into cavity 130 of female press cavity 132. Female press die 118 is, therefore, caused to also move in direction 128 further into cavity 130 of female press cavity 132. As a result, and as shown in FIG. 14A, folded flange 44 moves even further inward in directions 146 and 148 because of the angled slope of angled wall 140. This causes folded flange 44 to further tuck underneath edge 12 of paperboard container 100. This is because edge portion 138 of male press die 120 is pushing downward in direction 128 onto flange 44. This movement also causes female press die 118 to further compress springs 122, and 124 against their bias. In this view, tray 100 having a fully folded over flange is almost formed.

Figure 15:
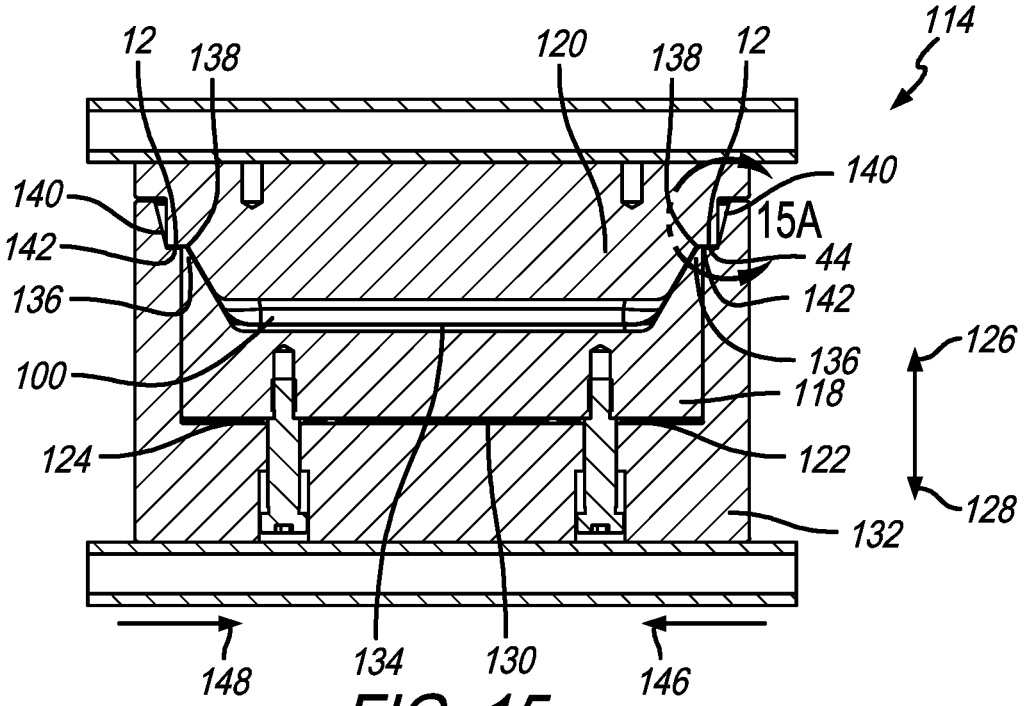
FIG. 15 is another side cross-sectional view of the pressboard press of FIG. 12.
Figure 15A:
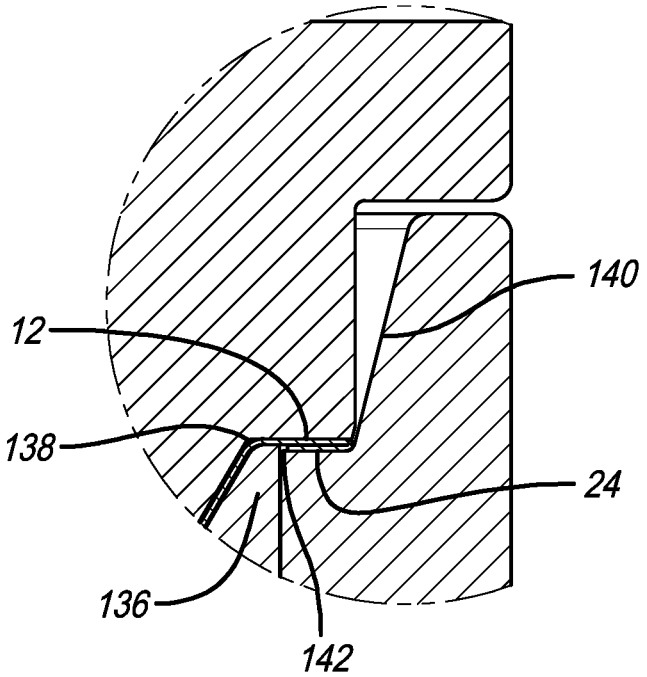
FIG. 15A is a side cross-sectional detail view of the pressboard press of FIG. 15 taken at "15A"
Figure 16:
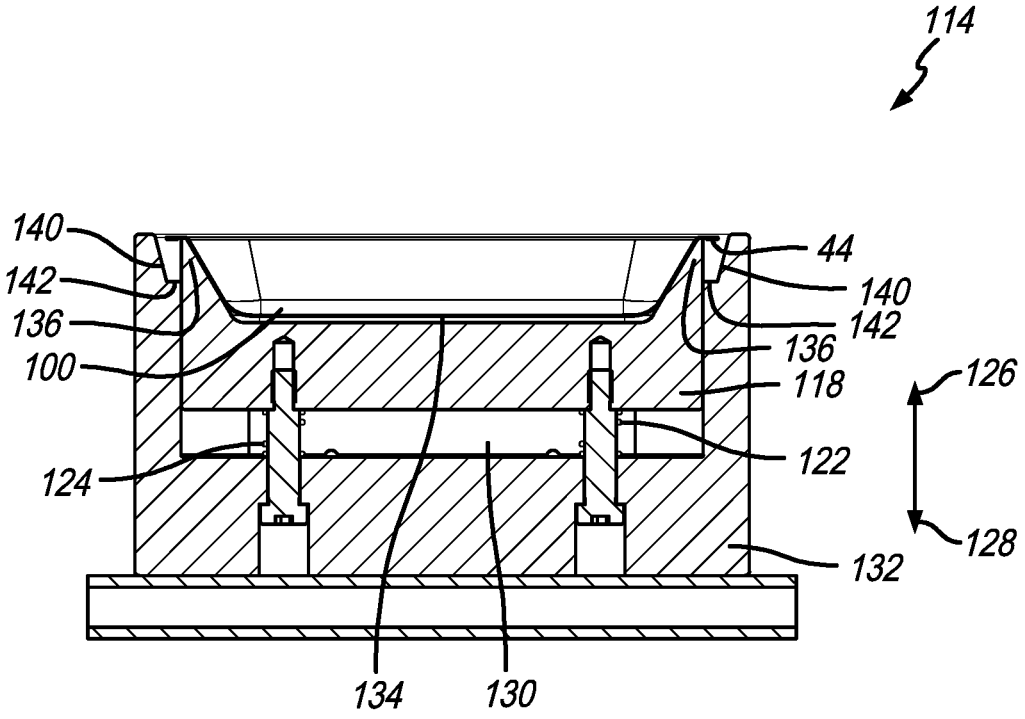
FIG. 16 is another side cross-sectional view of the pressboard press of FIG. 12.

Another side cross-sectional elevation view of paperboard container press 114 is shown in FIG. 15. Here male press die 120 is fully lowered into cavity 134 of female press die 118 to the extent edge portion 138 of male press die 120 engages ledge 142 on female press cavity 132. At this point, folded over flange 24 is fully formed as shown in FIG. 15A, and is no longer folded portion 44. As shown, female press die 118 is fully disposed in cavity 130 of female press cavity 132 and is fully compressing springs 122 and 124.

Once this forming process is complete, tray 100 can be removed. As shown in the further side cross-sectional elevation view of paperboard container press 114 in FIG. 16, male press die 120 is removed from female press die 118 and female press cavity 132. Female press die 118 then is free to move upward in direction 126 from cavity 130 of female press cavity 132 because of the bias of springs 122 and 124. This lifts paperboard tray 100 out of female press cavity 132 so it may be removed from paperboard container press 114.

Figure 17:
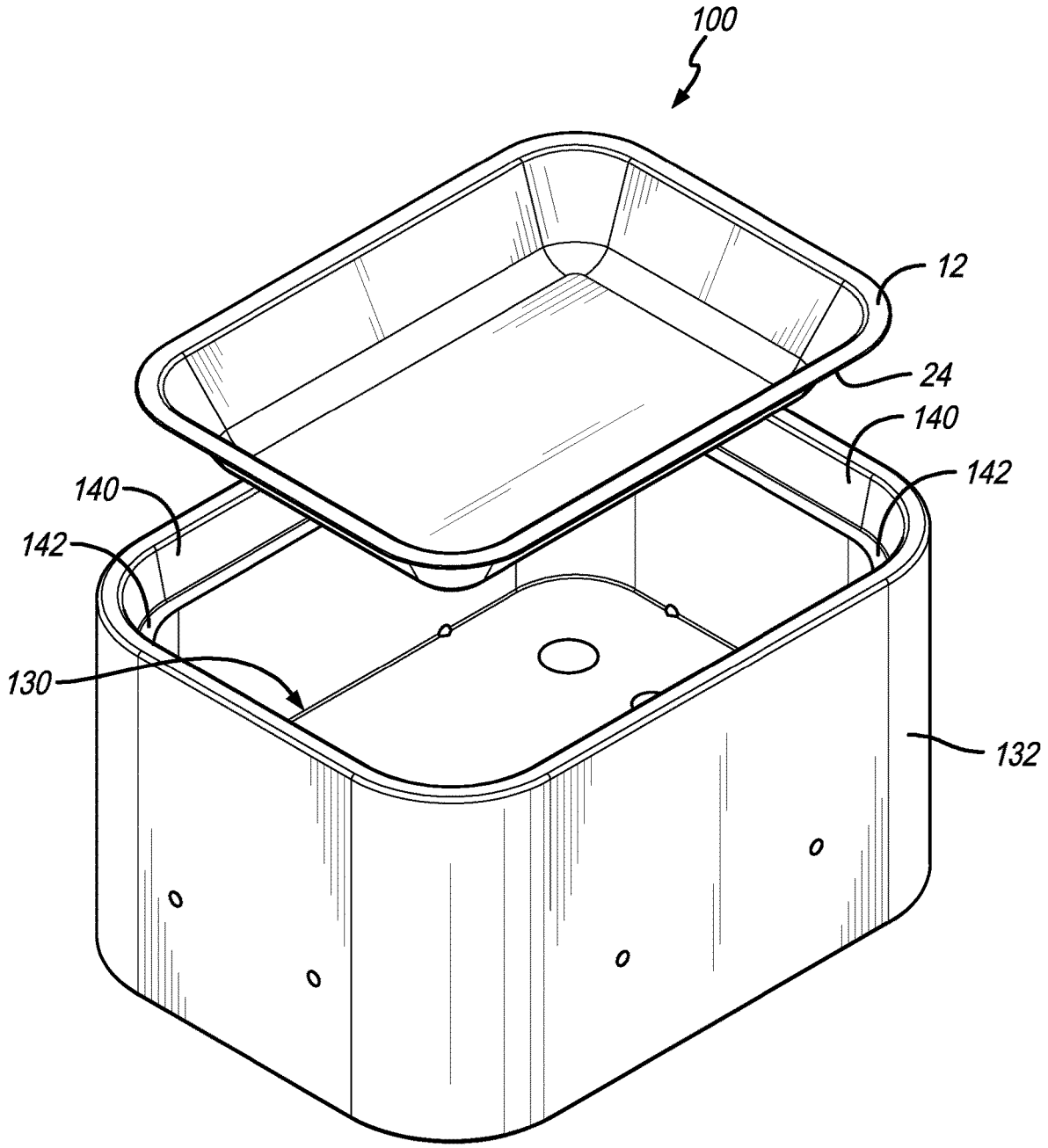
FIG. 17 is a perspective exploded view of a female press cavity portion of the pressboard press of FIGS. 12-16 and a paperboard tray.

A perspective view of female press cavity 132, with the illustrative embodiment of paperboard container 100, with a fully folded over flange 24 underneath, is shown in FIG. 17. Here, angled wall 140 of female press cavity 132 is shown along with ledge 142. Again, angled wall 140 is configured to push folded flange 44 inward to create the folded over flange 24 as tray 100 is moving linearly in direction 128 via movement of press dies 118 and 120 in cavity 130. An accurately-sized outer perimeter and rounded corners are formed having a smooth radius using the dies shown. This is in contrast to the slightly irregular corners that are typically formed in conventional flat-flanged tray.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features. It should also be appreciated that any subject matter disclosed in this non-provisional patent application that may differ from the priority application, the disclosure from this non-provisional patent application controls.

What is claimed is:

1. A paperboard servingware container comprising:

a bottom panel;

a curved transition portion located at the periphery of the bottom of panel;

an upwardly extending wall that extends from the curved transition portion opposite the bottom panel;

an angled or curved peripheral transition located adjacent the upward extending wall opposite the curved transition portion;

a ledge portion that extends from the angled or curved peripheral transition opposite the upward extending wall and away from the upward extending wall;

wherein the ledge portion is oriented about parallel to the bottom panel;

a folded over flange portion connected adjacent the ledge portion and bent underneath the ledge portion;

wherein the bottom panel, the curved transition portion, the upwardly extending wall, the angled peripheral transition, the ledge portion, and the folded over flange portion, are formed of a single continuous paperboard panel having a first surface and a second surface;

wherein the first surface of the single continuous paperboard panel is located opposite the second surface of the single continuous paperboard panel;

wherein a paper material is located between the first and second surfaces of the single continuous paperboard panel;

wherein at least the first surface of the single continuous paperboard panel is coated with a water resistant coating;

wherein the first surface of the single continuous paperboard panel of the bottom panel, the curved transition portion, and the upwardly extending wall, forms a receptacle sized to carry an item;

wherein the second surface of the single continuous paperboard panel of the bottom panel, the curved transition portion, the upwardly extending wall, and the first surface of the folded over flange portion forms an exterior of the paperboard servingware container;

wherein substantially all of the second surface of the folded over flange portion abuts the second surface of the ledge portion;

wherein as the folded over flange portion is bent underneath the ledge portion, no gap is created between the second surface of the folded over flange portion and the second surface of the ledge portion;

wherein the folded over flange portion includes an end that is exposed toward the second surface of the upwardly extending wall;

wherein the paper material extends to the end of the folded over flange portion; and an outer transition edge located between the ledge and the folded over flange portion;

wherein the outer transition edge serves as an outermost rim edge around the paperboard servingware container;

wherein the first surface of the outer transition edge is coated with the water resistant coating; and wherein the outermost rim edge is coated with the water resistant coating.

2. A paperboard servingware container comprising:

a bottom panel;

a curved transition portion located at the periphery of the bottom of panel;

an upwardly extending wall that extends from the curved transition portion opposite the bottom panel;

an angled or curved peripheral transition located adjacent the upward extending wall opposite the curved transition portion;

a ledge portion that extends from the angled or curved peripheral transition opposite the upward extending wall and away from the upward extending wall; and a folded over flange portion connected adjacent the ledge portion and is bent downwardly with respect to the ledge portion;

wherein the bottom panel, the curved transition portion, the upwardly extending wall, the angled peripheral transition, the ledge portion, and the folded over flange portion, are formed of a single continuous paperboard panel having a first surface and a second surface;

wherein the first surface of the single continuous paperboard panel is located opposite the second surface;

wherein the first surface of the single continuous paperboard panel of the bottom panel, the curved transition portion, and the upwardly extending wall, forms a receptacle sized to carry an item;

wherein substantially all of the second surface of the folded over flange portion abuts the second surface of the ledge portion; and wherein as the folded over flange portion is bent downwardly with respect to the ledge portion, no gap is created between the second surface of the folded over flange portion and the second surface of the ledge portion.

3. The paperboard servingware container of claim 2, wherein the second surface of the single continuous paperboard panel of the bottom panel, the curved transition portion, the upwardly extending wall, and the first surface of the folded over flange portion form an exterior of the paperboard servingware container.

4. The paperboard servingware container of claim 3, wherein the folded over flange portion includes an end that is exposed.

5. The paperboard servingware container of claim 3, wherein the folded over flange portion includes an end that is exposed toward the second surface of the upwardly extending wall.

6. The paperboard servingware container of claim 3, wherein the ledge portion is oriented about parallel to the bottom panel.

7. The paperboard servingware container of claim 3, wherein a paper material is located between the first and second surfaces of the single continuous paperboard panel.

8. The paperboard servingware container of claim 3, wherein at least the first surface of the single continuous paperboard panel is coated with a water resistant coating.

9. The paperboard servingware container of claim 3, wherein at least the first surface of the single continuous paperboard panel is coated with a water resistant coating.

10. The paperboard servingware container of claim 3, wherein the paper material extends to the end of the folded over flange portion.

11. The paperboard servingware container of claim 3, further comprising an outer transition edge located between the ledge and the folded over flange portion.

12. The paperboard servingware container of claim 11, wherein the outer transition edge serves as an outermost rim edge around the paperboard servingware container.

13. The paperboard servingware container of claim 12, wherein the outermost rim edge is coated with the water resistant coating.

14. The paperboard servingware container of claim 11, wherein the first surface of the outer transition edge is coated with a water resistant coating.

* * * * *